US005913515A

United States Patent [19]

Takemoto et al.

[11] Patent Number: 5,913,515

[45] Date of Patent: Jun. 22, 1999

[54] GAME MACHINE WITH DISPLAY DEVICE AND SPECIAL CONDITION GENERATION

[75] Inventors: Takatoshi Takemoto; Noriyuki Ito, both of Tokyo, Japan

[73] Assignee: Kabushiki Kaisha Ace Denken

[21] Appl. No.: 08/945,204

[22] PCT Filed: Jan. 22, 1996

[86] PCT No.: PCT/JP96/00099

§ 371 Date: Oct. 10, 1997

§ 102(e) Date: Oct. 10, 1997

[87] PCT Pub. No.: WO96/32170

PCT Pub. Date: Oct. 17, 1996

[30] Foreign Application Priority Data

Apr. 10, 1995 [JP] Japan ..... 7-084202

[51] Int. Cl.[6] ..... A63F 7/02

[52] U.S. Cl. ..... 273/121 B

[58] Field of Search ..... 273/118 R, 118 A, 273/119 R, 119 A, 121 R, 121 A, 121 B

[56] References Cited

U.S. PATENT DOCUMENTS 4,055,342 10/1977 Matsumoto ..... 273/121 B

FOREIGN PATENT DOCUMENTS 60-109681 7/1985 Japan .
62-45072 3/1987 Japan .
6-63247 3/1994 Japan ..... 273/121 B
6-178847 6/1994 Japan ..... 273/121 B
6-285235 10/1994 Japan ..... 273/121 B
6-285248 10/1994 Japan ..... 273/121 B

*Primary Examiner*—Raleigh W. Chiu

*Attorney, Agent, or Firm*—Seed and Berry LLP

[57] ABSTRACT

This invention relates to game machine apparatus having a display device and generating a special condition. In one embodiment, a game machine that varies the display content on a display device provided on a panel thereof, and generates a special condition advantageous to a player when a display result matches a predetermined condition, includes a display manager, a control device, and a special condition generating device. The display manager advances a special game and displays a successively-varying game while no pinball driven onto a panel of the game machine enters a special prize-winning port. The control device executes a one unit game from the current state of the proceeding game series and displays an execution result of the one unit game on the display device when a pinball driven onto the panel of the game machine enters the special prize-winning port. The special condition generating device generates a special condition advantageous to the player when the execution result of the one unit game meets a predetermined condition. In the above-described game machine, the control device may determine the execution result of the one unit game on the basis of a predetermined algorithm. In an alternate embodiment, the display manager displays on the display device a baseball scene viewed from behind a back net showing a pitcher who pitches at a fixed interval in a baseball field and a batter who lets a pitch go by, and also a current game status containing a strike count, a ball count, an out count, and a get-to-base condition of a runner. The control device determines one of a single-base hit, a two-base hit, a three-base hit, a home-run hit and an easy fly as the execution result of the one unit game when a pinball enters the special prize-winning port, and changes the display content to a scene depicting conditions after the batter bats a ball.

10 Claims, 4 Drawing Sheets

*Fig. 1B*

GAME MACHINE WITH DISPLAY DEVICE AND SPECIAL CONDITION GENERATION

The present invention relates to a game machine, and particularly to a game machine having a display device on the game machine console panel and generating a special condition advantageous to a player when a predetermined condition is met.

BACKGROUND

Game machines, such as pinball machines, etc. may be classified into three types. A first type of game machine includes a liquid crystal display as a display device and generates a special condition advantageous to a player as an award (or prize-winning) when the display content on the liquid crystal display device is set to a special condition, such as, for example, when a set of numerals or patterns coincides with another set of numerals or patterns (a so-called "fever machine"). A second type of game machine generates a special condition when a pinball entering into a mechanical central prize-winning unit enters a special prize-winning port (a so-called "wing machine"). Finally, a third type of game machine has a mechanism which, after a prize-winning, makes it easier to obtain a next prize-winning if a special condition is met (a so-called "right-reserving machine"). Here, the prize-winning unit is defined as either a prize-winning port having a special mechanism, or simply the special mechanism itself.

Some game machines of the first and second types have been recently spotlighted because they produce display patterns on liquid crystal displays which may visually excite users. More specifically, each pattern is displayed in a scroll mode in response to a pinball falling into a special prize-winning port on a panel of the game machine. After the scroll display is stopped, if the pattern displayed is coincident with one of a number of special combinations, the game machine is kept in a special state, such as, for example, a state in which a variable prize-winning port (or "big prize-winning port") starts an opening and closing operation so that the player is provided with a prize-winning chance having a relatively higher probability of winning than when the game machine is under a usual play state.

In the above-described game machines, the patterns displayed on the display device are changed in a scroll mode such that the display patterns (e.g. numerals, etc.) are successively scrolled on the screen of the display device. These patterns are similar among game machines which are provided by different manufacturers. In addition, the conditions under which the special states are generated are common among the different game machines so that these game machines tend to lack novelty and amusement performance.

As described above, the process of gaining a combination of various patterns on the display device is simple and uniform in the conventional game machines which limits the ability of these machines to enhance a player's expectation of experiencing a special state. This limitation makes it difficult to further stir up the gambling spirit of the player or to further visually excite the player. Therefore, conventional game machines suffer from a lack of novelty and decreased game performance.

Furthermore, in conventional game machines, achieving a special combination of various patterns on the display device to generate a special state must be performed individually and independently every time. This is also a factor which reduces game performance.

DISCLOSURE OF THE INVENTION

The present invention has been implemented in view of the foregoing problems of the prior art. One object of the invention is to provide a game machine in which a game scene constantly proceeds on a display device even while a game for gaining a condition to generate a special condition is not played. A condition to start the game for generating a special condition during consistently continuing game scenes is varied at all times, thereby enhancing the game performance of the game machine and sufficiently meeting the expectations and gambling spirit of players. Thus, there can be provided a game machine which appeals to the player for a long time.

In one embodiment, a game machine that varies the display content on a display device provided on a panel thereof when a pinball driven onto the panel of the game machine enters a special prize-winning port, and generates a special condition advantageous to a player when a display result after the variation meets a predetermined condition, includes: display means for advancing a special game and displaying a successively-varying game scene with the current state of the special game being renewed while no pinball driven onto the panel of the game machine enters the special prize-winning port;

control means for executing a one unit game from the current state of the proceeding game series and displaying an execution result of the game on the display device when a pinball driven onto the panel of the game machine enters the special prize-winning port; and special condition generating means for generating a special condition advantageous to a player when the execution result of the one unit game meets a predetermined condition.

In the above-described game machine, the control means may determine the execution result of the one unit game on the basis of a predetermined algorithm.

In an alternate embodiment, the display means displays on the display device a baseball scene viewed from behind a back net showing a pitcher who pitches at a fixed interval in a baseball field and a batter who lets a pitch go by, and also a current game status containing a strike count, a ball count, an out count, and a get-to-base condition of a runner. The control means determines one of a single-base hit, a two-base hit, a three-base hit, a home-run hit and an easy fly as the execution result of the one unit game when a pinball enters the special prize-winning port, and changes the display content to a scene depicting conditions after the batter bats a ball thrown by the pitcher in accordance with the execution result, and displays the result of the one unit game on the display device. The special condition generating means generates a special condition corresponding to a score when the result of the one unit game makes the score (corresponding to the predetermined condition) in combination with a game scene that was displayed just before the one unit game started. In this embodiment, the display means increments the out count and also resets the strike count and the ball count to zero respectively when the result of the one unit game by the control means indicates an easy fly or three strikes in a state where the one unit game is not completed. Further, when the out count is set to 3, the display means resets the strike count, the ball count, the out count, and the get-to-base condition of a runner.

In an alternate embodiment, the control means may be designed so that a set of hit rates (or batting statistics) for each of nine batters (e.g. a single-base hit rate, a two-base hit rate, a three-base hit rate, a home-run hit rate and an easy fly rate) appears on the scene in turn every one unit game, and the result of the one unit game is determined so as to conform to the hit rates of the batter who appears on the scene at that time.

In yet another embodiment, a pinball machine according to the present invention includes:

a game machine console including a large number of pins for disturbing movement of a pinball, a special prize-winning port into which only one pinball can enter at a time, a variable prize-winning port which is ordinarily kept closed and into which a plurality of pinballs can enter at a time, and an outlet port for withdrawing pinballs which do not enter into the prize-winning port;

driving means for continuously driving pinballs onto the game machine console, the driving means being manipulated by a player;

detecting means for detecting the entrance of a pinball into the special prize-winning port;

a display device provided on a panel of the game machine console;

display means for advancing a special game and displaying a successively-varying game scene with the current state of the special game being renewed while no pinball driven onto the panel of the game machine enters the special prize-winning port;

control means for starting and executing a one unit game from the current state of the proceeding game and displaying the execution result of the game on the display device when a pinball driven onto the panel of the game machine enters the special prize-winning port; and special condition generating means for generating a special condition advantageous to a player when the execution result of the one unit game meets a predetermined condition.

In a pinball machine, various constructions may be adopted to create a variety of alternate embodiments, as in the case of the game machine mentioned above.

In the specification, the term "one unit game" corresponds to the processing from the time when a batter takes his turn at the bat until the time when he makes a hit or a put-out in an alternate embodiment as described below.

In the game machine according to the present invention, a player can enjoy not only playing a game on the game machine, but also a display game on the display device. In addition, when a pinball enters the special prize-winning port, the play can expect the game machine to generate a special condition advantageous to the player in accordance with the execution result of one unit game. The execution result of the one unit game is dependent on the current game state at the execution start time of the game (the number of runners, the positions of the runners and the type of hit in a baseball game, for example), and the degree of the special condition is varied in accordance with the execution result (score), so that the game is not monotonous, and thus, the player can enjoy a thrilling game.

DETAILED DESCRIPTION OF THE INVENTION

An embodiment according to the present invention will now be described with reference to the attached drawings.

FIGS. 1*a* to 5 show an embodiment of the present invention.

Figure 1A:
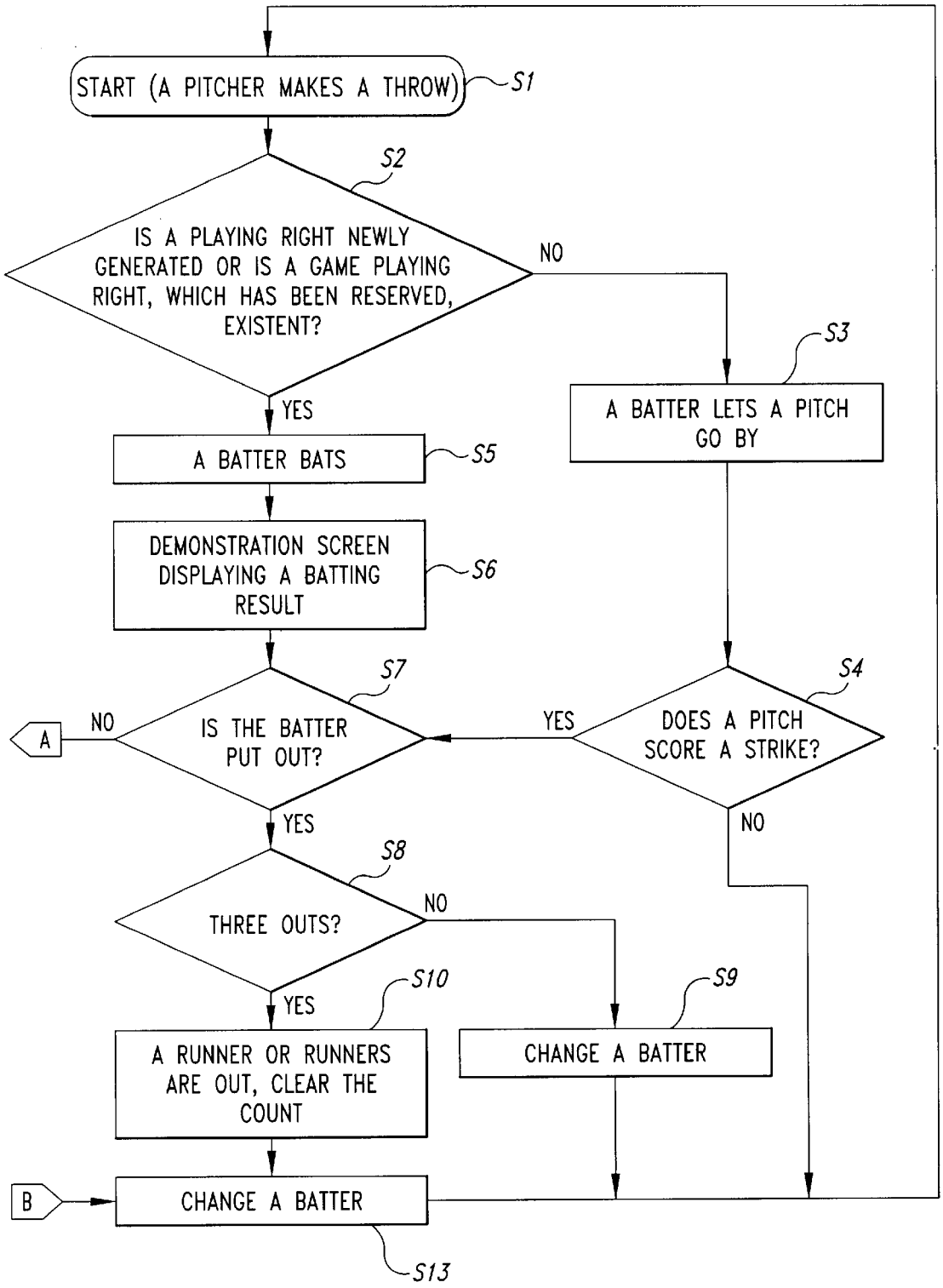
FIG. 1*a* is a first part of a flowchart showing a game process in a game machine according to an embodiment of the present invention.
Figure 1B:
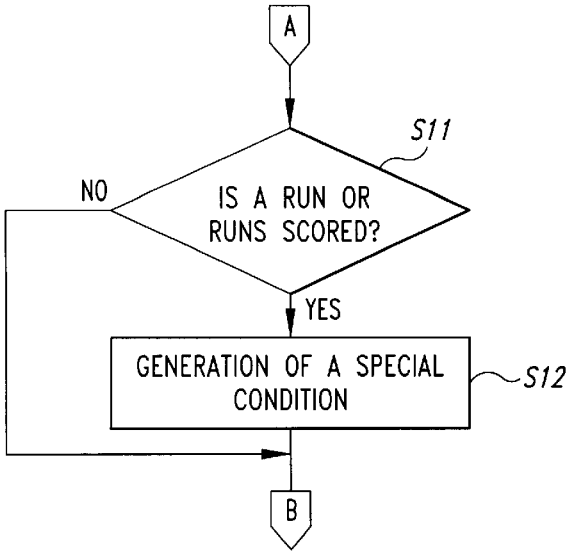
FIG. 1*b* is a second part of the flowchart of FIG. 1*a;*
Figure 2:
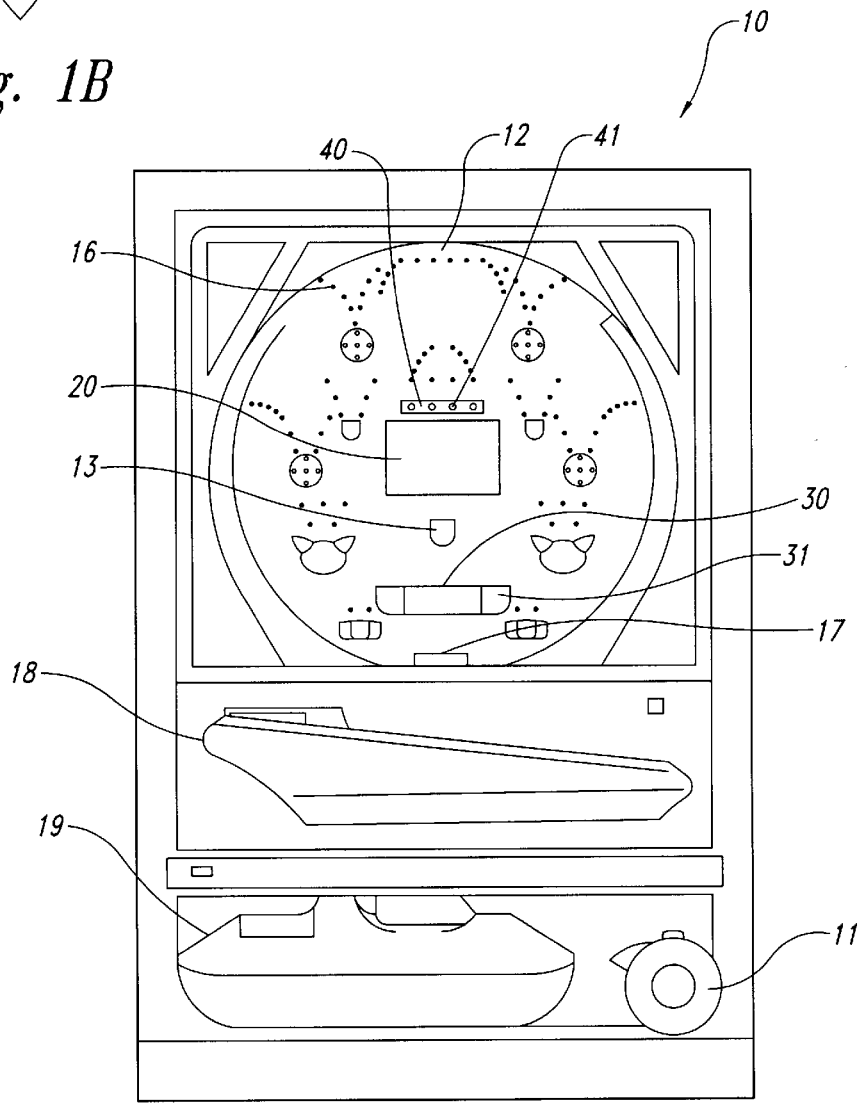
FIG. 2 is a front view of a game machine embodiment corresponding to the game process flowchart of FIG. 1*a* and FIG. 1*b;*

A game machine 10 according to the embodiment is a pinball machine in which a player rotates a handle 11 at a lower right side of the game machine at a desired rotational angle to drive pinballs onto a panel surface 12 of a game machine console, with the driving strength corresponding to the rotation angle of the handle at a fixed period determined by a pinball driving device (not shown), in order to cause a large number of prize pinballs to enter into a prize-winning port as shown in FIG. 2.

The pinball machine which is exemplified as the game machine operates according to programs stored within a controller 50 so that one unit game is carried out in a game scene being displayed on a display device 20 on the basis of a pinball entering into the special prize-winning port 13 on the panel 12 of the game machine console. Various special conditions are generated by a special condition generator 30 if the display result meets a predetermined condition. The game machine according to the present invention is applicable not only to a pinball machine, but also various types of game machines using balls as game media (for example, a ball arranging machine, etc.).

As shown in FIG. 2, the special prize-winning port 13 is located substantially at the center portion of the panel 12 of the game machine console. The display device 20 on which a varying game scene can be displayed is located at the upper side of the special prize-winning port 13, and the special condition generator 30 is located at the lower side of the special prize-winning port 13. Furthermore, a large number of pins 16 for disturbing free movement of pinballs, various prize-winning units its, various prize-winning ports, an outlet port 17, etc. are located at table places on the panel of the game machine console. The controller 50 (see FIG. 5) is installed within a rear side of the game machine console panel 12. At a lower side of the game machine console panel 12 there are provided a front pan 18 for storing pinballs to be used for the game and a lower pan 19 for reserving pinballs overflowing from the front pan 18. A surface side of the panel 12 of the game machine console is covered with protection glass.

The display device 20 is a centrally located prize-winning unit which performs a "baseball game" to generate a special condition advantageous to a player on the basis of a pinball entering into the special prize-winning port 13. Under the control of the controller 50, the display device 20 is allowed to change its display content from a display content indicating a state where no pinball enters the special prize-winning port 13 (hereinafter referred to as the "usual state") to a display content corresponding to an execution result of one unit game through the progress of the one unit game to generate a special condition, in response to a pinball entering into the prize-winning port 13.

More specifically, the display device 20 comprises a color liquid crystal display, such as, for example, an STN (simple matrix) type or a TFT (active matrix) type liquid crystal display. Although the STN type is lower in price than the TFT type, it is lower in contrast than the TFT type, and thus the display content of the STN type is only slightly visible unless it is viewed from the front side. On the other hand, the TFT type provides an image which is only slightly blurred, and thus, a sharp image can be obtained. However, a TFT type display is expensive. Either of the STN type or the TFT type may be used for the display device 20 of this embodiment. Furthermore, the display device 20 is not limited to a color liquid crystal display, and may be a monochromatic liquid crystal display, a plasma display, a fluorescent character display tube, a Braun tube (CRT) or the like.

Figure 3:
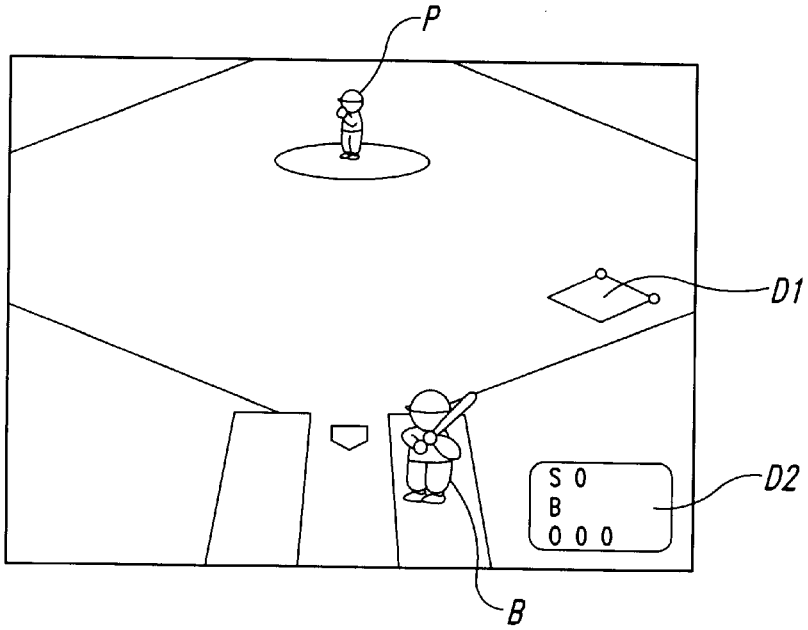
FIG. 3 is a diagram showing a scene of a baseball game displayed on a display device under a usual state.

FIG. 3 shows a game scene which is displayed on the display device 20 in the usual state and just after one unit game is started. The scene on the screen corresponds to a view of the infield from behind the back net at the back side of a home base in a baseball field. In the usual state, a pitcher P on a mound, a batter B standing on a batter box while a holding a bat, a home base, and a part of a diamond are displayed on the screen.

A rhombus displayed at a first base side of the diamond represents a runner display portion DI which indicates the existence of a runner at each base, with the position of an existing runner being represented by a circle affixed at a corner of the rhombus. For example, FIG. 3 shows that runners are on first and second bases. Further, "S", "B" and "O" are displayed in the vertical direction within a rectangular frame at the lower right corner on the screen. This frame represents a count display portion D2 for displaying a strike count, a ball count and an out count. The count value is represented by the number of circles which are displayed adjacent to each of these characters. For example, FIG. 3 indicates one strike because the number of circles adjacent to S is equal to 1, no balls because the number of circles adjacent to B is equal to zero, and two players out because the number of circles adjacent to 0 is equal to 2. In the usual state, where no pinball enters the special prize-winning port 13, the display on the screen is set so that the pitcher P pitches at a fixed interval and the batter B lets the pitch go by.

Figure 4:
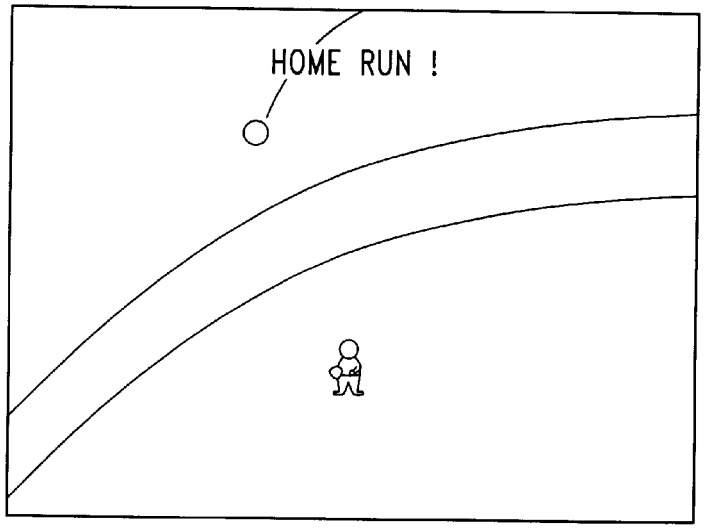
FIG. 4 is a diagram showing another scene of a baseball game displayed on the display device in the progress of one unit game of the present invention.

When one unit game to generate a special condition on the basis of a pinball entering into the special prize-winning port 13 is started, a series of scenes are displayed as shown in FIG. 3 until the batter B bats a ball. FIG. 4 shows a frame displayed after the batter B bats the ball, and shows a scene in which the batted ball is followed.

The display device 20 as described above is set so that the display content, the variation of the display content, etc. are controlled by the controller 50 as will be described below.

Figure 5:
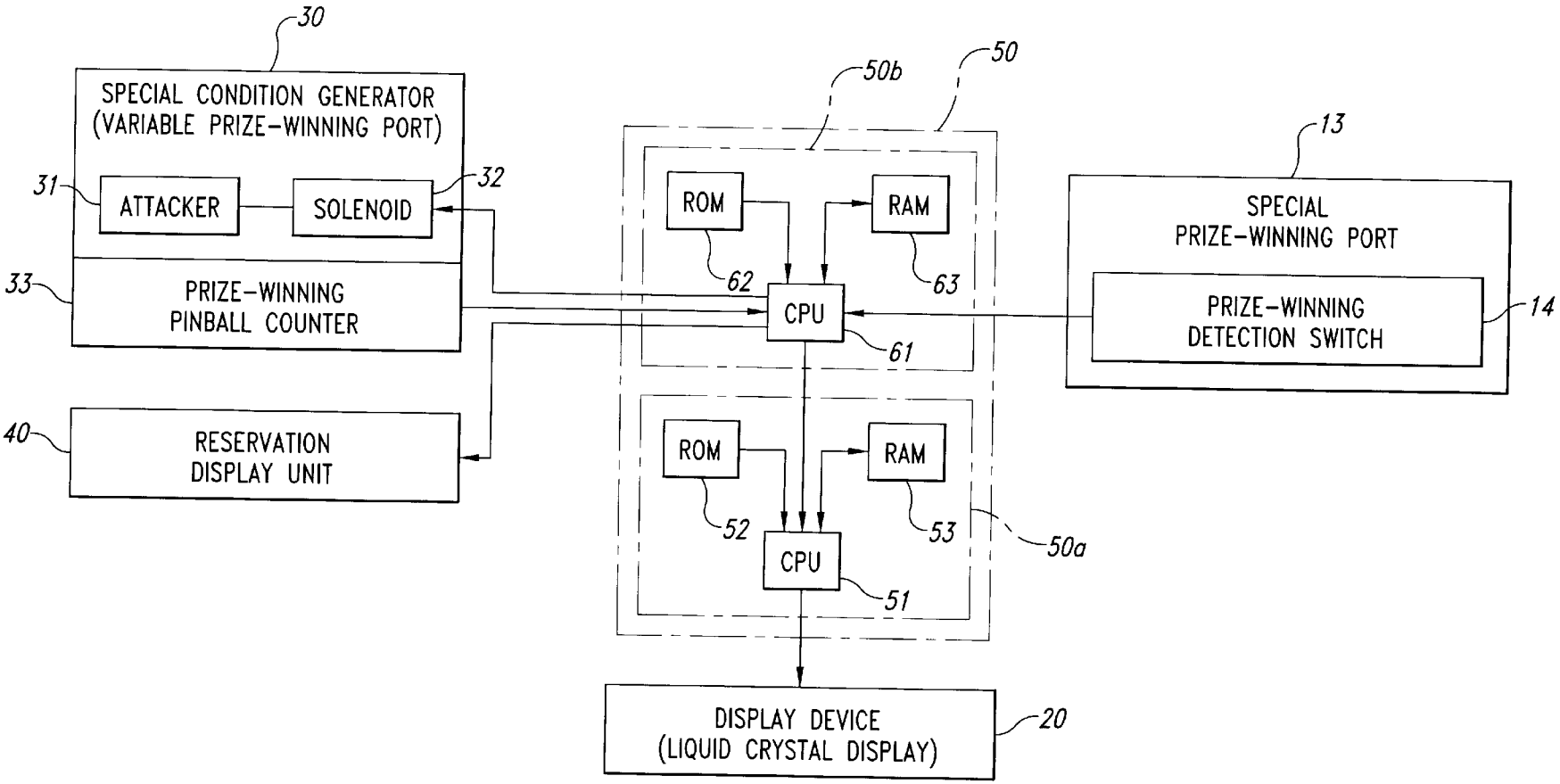
FIG. 5 is a functional block diagram corresponding to the game machine of FIG. 2.

The special prize-winning port 13 (also called a "chukker") is provided with a prize winning entrance of a pinball (see FIG. 5). The prize-winning detection switch 14 is connected to the controller 50 so that when it is switched on upon detection of an entering pinball, it outputs a prizewinning signal to the controller 50. The prize-winning detection switch 14 may include various sensors, such as, for example, an optical sensor, a contactless sensor, or a magnetic sensor.

The special condition generator 30 comprises a variable prizewinning port which is usually kept closed, but intermittently repeats the opening and closing operation a predetermined number of times when a predetermined condition is satisfied during one unit game, specifically, when a score of 1 to 4 points is obtained. The variable prize-winning port is designed to be sufficiently larger in size than the special prize-winning port so that a plurality of pinballs of can enter into the variable prize-winning port at one time, and it may, for example, be designed to have a rectangular opening. The special condition generator 30 is provided with an attacker (a prize-winning device having a door which is opened and closed in the back-and-forth direction of the panel of the game machine console) 31 and a solenoid 32 (see FIG. 5) serving as driving means for the attacker. On the basis of a special condition generating signal from the controller 50 (described below), the variable prize-winning port releases the attacker 31 for 5 seconds only once, for example when the score is one point, and releases the attacker 31 twice for 5 seconds at a short time interval (2 seconds, for example) when the score is 2 points. Furthermore, when the score is 3 points, that is, when a three-bagger is hit while all the bases are filled or a home run is hit while two bases are filled, the attacker 31 is opened over a predetermined time (29 seconds, for example). When the score is 4 points, that is, when a home run is hit while all the bases are filled, the attacker 31 is set to a so-called "fever state" where the attacker 31 continuously repeats at a predetermined number of rounds (for example, 16 rounds) such a special-condition generating operation that it is opened over a predetermined time (29 seconds, for example) and then closed for a short time (2 to 3 seconds, for example).

A reservation display unit 40 is also provided on the panel 12 of the game machine console. When pinballs newly enter into the special prize-winning port 13 during the progress of the one unit game, the reservation display unit 40 displays a right-reserving frequency of one unit game which has not yet been performed in spite of the prizewinning of the pinballs. The reservation display unit 40 is set so as to display a right-reserving frequency stored in the controller 50 on the basis of a reservation display signal from the controller 50 as described later.

As shown in FIG. 2, the reservation display unit 40 has four display lamps 41, and the player's right to the one unit game which has not yet been performed can be reserved up to a total of four times. That is, the display lamps 41 are controlled so that display lamps whose number is equal to the right reservation frequency are turned on. When the reserved one unit game is performed, the frequency at which the one unit game is performed is subtracted from the right reservation frequency, and the storage content of the controller is renewed and then stored with the subtraction result, whereby the frequency thus stored is newly displayed on the reservation display unit 40. Furthermore, in the case where the right is reserved at the maximum frequency (i.e., at four times), even when a pinball enters the special prize-winning port 13, the right to be generated due to the entrance of the pinball is canceled.

The controller 50 shown in FIG. 5 includes a display controller 50*a* for controlling the display content of the display device 20, and a game controller 50*b* for controlling the operation of the special condition generator 30. The display controller 50*a* comprises a microcomputer including at least CPU 51, ROM 52, RAM 53, etc. Similarly, the game controller 50 comprises a microcomputer including at least CPU 61, ROM 62, RAM 63, etc. The display controller 50*a* and the game controller 50*b* are connected to each other through a bus, etc. (which may contain a register (not shown)).

The CPU 51 of the display controller 50*a* controls the display content of the display device 20 according to a display control program and data stored in the ROM 52. The CPU 51 is connected to the display device 20. In the ROM 52 are stored fixed data such as the display control program to control the display content of the display device 20, data, etc.

In the RAM 53 are temporarily stored the strike count, the ball count, the out count and various data on runners. Pattern data are stored in the ROM 52 or in a hard disc device (not shown) in a nonvolatile state, and the data are transmitted to the RAM 53. The various data of the RAM 53 are read out on the basis of an instruction from the CPU 62 as described below, or the CPU 51, and output to the display device 20.

Further, the CPU 61 of the game controller 50*b* controls the operation of various prize-winning units containing the special condition generator 30 according to the game control program and the data stored in the ROM 62. The CPU 61 is connected to the prizewinning detection switch 14, the prize-winning pinball counter 33, etc. In the ROM 62 are stored fixed data, such as a game control program and data for controlling the special condition generator 30, a turn-on pattern of decorative lamps (not shown) for rendering the entrance of pinballs to the various prize-winning units, a generation pattern of voices from a speaker, etc. In the RAM 63 are temporarily stored various data on a game which contain signals from the prizewinning detection switch 14 and the prize-winning pinball counter 33.

Next, the operation of the game machine thus constructed will be described.

By operating the handle 11 to drive pinballs onto the game machine console panel 12 (see FIG. 2), a player aims at and enjoys the entrance of the pinballs into each prize-winning unit. In the usual state, the scene shown in FIG. 3 is displayed at all times on the display device 20, and the pitcher P pitches at a fixed interval (step 1) and the game proceeds. When a pinball enters the special prize-winning port 13, the game machine determines whether a new game executing right is generated or whether the execution right of a repaired game exists (step 2). If the result is "No", the batter B definitely lets a pitch go by (see FIG. 1*a* and FIG. 1*b*, step 3). The pitch is counted as a strike or a ball (step 4). This processing may be performed randomly or according to a predetermined algorithm by the program. When the pitch is counted as a strike, the strike count is incremented by 1. On the other hand, when the pitch is counted as a ball, the ball count is incremented by 1. However, the program is set so that no batter gets a base on balls alone. That is, after three balls, the pitch is definitely counted as a strike. If the game proceeds so that no pinball enters the special prize-winning port 13, the batter lets a pitch go by for all balls and gets struck out, and thus the out count is incremented by 1 (step 7). At the same time, the strike count and the ball count are cleared. If the out count is not equal to 3 (step 8), the batter B is changed to another and the next batter appears on the scene (step 9). When the out count is equal to 3 (step 8), the runners on the bases and the out count are cleared (step 10). Subsequently, another batter appears on the scene (step 13). The ball count and the strike count are displayed on the count display unit D2 every pitch. The runners on the bases are displayed on the runner display unit D1.

When a pinball enters the special prize-winning port 13 in the progress of a pinball game, the prize-winning detection switch 14 outputs the prize-winning signal to the controller 50 (FIG. 5). At this time, execution rights (up to four) can be reserved when the baseball game is in progress on the display device 30, and one unit game is executed on the display device on the basis of an instruction from the controller 50 when the baseball game is not in progress. The increasing/decreasing processing of the suspension frequency of the execution right is performed in parallel to the processing of FIG. 1B, although it is not shown in the figures.

In step 5, the batter B definitely bats the ball. The controller 50 draws a lottery from a single hit, a two-base hit, a three-base hit, a home run hit and an easy fly (corresponding to a blank), and displays a scene corresponding to the lottery result on the display device 20 (at the prize-winning time, subsequent to the game scene being displayed at the time when a pinball enters the prize-winning port 13, step 6). For example, if the game scene at the prize-winning time the pinball enters into the prize-winning port 13 indicates that runners are on first and second bases with two players out, and at this time the lottery result is set to a home-run hit, the one unit game result indicates that all the runners return "alive" and the score is equal to 3 points. As a result, the controller 50 transmits a special condition generating instruction to the special condition generator 30, causing the special condition generator 30 to generate the special condition corresponding to the score of 3 points. When the special condition is set as described above, the attacker 31 is opened for a predetermined time (e.g. 29 seconds) once (step 11, 12), and the one unit game is finished. In step 11, the strike count and the out count are cleared.

If no score is gained in spite of safe hits, the number of runners is incremented by 1 and the next batter appears on the scene (step 11, 13). If a score is gained and there is a runner remaining, the runner and the batter who makes the hit are set as new runners. Furthermore, when the batter makes an easy fly, the same step occurs as in the case where the out count is incremented by 1 under the usual state (described above), and the one unit game is finished.

Next, the variation of the display on the display device 20 after the one unit game is started will be described. Assume that the pitcher P throws a ball in the state shown in FIG. 3 where the runners are on first and second bases with two players out. As described above, the batter B definitely bats the ball (step 5). Accordingly, the frame is changed to a ball-following frame as shown in FIG. 4 (step 6). In the event that the ball jumps into the outfield bleachers and an indication "Home Run !" appears on the scene, the player knows that a home run has been hit. The score is set to equal 3 points and the special condition as described above is generated. At this time, the score may be displayed to let the player know that the score is equal to 3 points.

Thereafter, if the right of the non-executed game is not reserved, the display on the frame is changed to the scene under the usual state, and it is displayed that there is no runner. The strike count and the ball count are reset, and the out count is not incremented by 1 and is displayed as it is. At that point, the one unit game is finished.

When the one unit game is finished, the pitcher P starts pitching at a fixed interval again on the display device 20, and the strike count, the ball count and the out count are advanced for every pitch until a next one unit game is started. In step 6, in the case of the single hit, the two-base hit or the three-base hit, the corresponding frame is displayed.

The controller 50 may cause up to nine batters to appear in turn one by one every time the out score is incremented by 1. For each of the nine batters, a single hit rate, a two-base hit rate, a three-base hit rate, a home-run hit rate and an easy fly rate may be set so that the lottery result based on a pinball entering into the special prize-winning port 13 is matched with the hit rates of the batter who appears on the scene at that time.

In the case where the right of the non-executed game is reserved at the time when the one unit game is finished, a next one unit game is subsequently executed on the display device on the basis of an instruction from the controller 50.

The right reservation frequency for the one unit game which is performed at this time is subtractively displayed by turning out the display lamps 41 of the reservation display unit shown in FIG. 2. As described above, in the case where the one unit game is in progress when a pinball enters the special prize-winning port 13, the one unit game can be reserved up to a maximum of four times. At this time, the right reservation frequency is additionally displayed by turning on the display lamps 41 of the reservation display unit 40. When a pinball enters the special prize-winning port 13 under the state where the right is reserved at the maximum value, that is, at four times, the right that would otherwise be generated due to the entrance of the pinball is automatically canceled.

In order to further enhance the game performance, the program may be set so that a batter gets a base on balls, on a wild pitch, on a passed ball or on a dead ball in some rare cases.

As described above, according to the game machine 10 of the present invention, one unit games which aim to generate a special condition advantageous to a player are continuously performed in connection with one another in a game scene which proceeds at all times, so that the condition at the start time of the game is varied at all times and high game performance can be achieved.

Accordingly, the player can enjoy the displayed game itself, and in addition, the player's expectation of generating various special conditions on the basis of a game result is enhanced to further stir up the player's gambling spirit and satisfy the player's desire.

INDUSTRIAL UTILITY

The present invention is applicable to a game machine, such as, for example, a pinball machine or the like, and it serves to improve the expectation and gambling spirit of players because the game performance of the game machine is dramatically enhanced by the continuity of games which is not provided in any conventional game machine.

What is claimed is:

1. A game machine which varies a display content on a display device provided on a panel thereof when a pinball driven onto the panel of the game machine enters a special prize-winning port for generating a special condition advantageous to a player when a display result after the variation coincides with a predetermined condition, comprising:

display means for advancing a special game and displaying a successively-varying game scene with a current state of the special game being renewed while any pinball driven onto the panel of said game machine does not enter said special prize-winning port;

control means for executing a one unit game from the current state of the proceeding game and displaying an execution result of the game on said display device when a pinball driven onto the panel of said game machine enters said special prize-winning port; and special condition generating means for generating a special condition advantageous to the player when the execution result of the one unit game meets a predetermined condition.

2. The game machine according to claim 1 wherein said control means determines the execution result of the one unit game on the basis of a predetermined algorithm.

3. The game machine according to claim 1 wherein said display means displays, on said display device, a baseball scene viewed from behind a back net having a pitcher who pitches at a fixed interval in a baseball field and a batter who lets a pitch go by in the baseball field, and a strike count, a ball count, an out count and a get-to-base condition of runners as the current state; and wherein said control means displays as the execution result of the one unit game any one of a single hit, a two-base hit, a three-base hit, a home-run hit and an easy fly when a pinball enters said special prizewinning port, the control means further lets the batter bat a ball thrown by the pitcher in accordance with the execution result, and changes the display content to a scene depicting conditions after the ball is batted and displays the result of the one unit game on said display device; and wherein said special condition generating means generates the special condition corresponding to a score when the execution result of the one unit game makes the score corresponding to the predetermined condition on the basis of a combination with the game scene that was displayed just before the one unit game started.

4. The game machine according to claim 3 wherein said display means increments the out count and also resets the strike count and the ball count to zero respectively when the execution result of the one unit game determined by said control means is an easy fly or a third strike in a state where the one unit game is not completed, and wherein said display means resets the strike count, the ball count, the out count and the get-to-base condition when the out count is set to 3.

5. The game machine according to claim 3 wherein said control means displays on the display means a single-base hit rate, a two-base hit rate, a three-base hit rate, a home-run hit rate and an easy fly rate for each of up to nine batters in turn every one unit game, the execution result of the one unit game being based on the hit rates of the batter appearing on the scene at that time.

6. A pinball machine comprising:

a game machine console including a large number of pins for disturbing movement of a pinball, a special prize-winning port into which only one pinball can enter at a time, a variable prize-winning port which is ordinarily kept closed and into which a plurality of pinballs can enter at a time, and an outlet port for withdrawing pinballs which do not enter into either of the prize-winning ports;

driving means for continuously driving pinballs onto said game machine console, the driving means being manipulated by a player;

detecting means for detecting a pinball entering into said special prize-winning port;

a display device provided on the panel of said game machine console;

display means for advancing a special game and displaying a successively-varying game scene, the special game having a current state that is renewed while any pinball driven onto the panel of said game machine does not enter said special prize-winning port;

control means for executing a one unit game from the current state of the proceeding game and displaying an execution result of the one unit game on said display device when a pinball driven onto the panel of said game machine console enters said special prize-winning port; and special condition generating means for generating a special condition advantageous to the player when the execution result of the one unit game meets a predetermined condition.

7. The pinball machine according to claim 6 wherein said control means determines the execution result of the one unit game on the basis of a predetermined algorithm.

8. The pinball machine according to claim 6 wherein said display means displays, on said display device, a baseball scene viewed from behind a back net having a pitcher who pitches at a fixed interval in a baseball field and a batter who lets a pitch go by in the baseball field, and a strike count, a ball count, an out count and a get-to-base condition of runners as the current state; and wherein said control means determines as an execution result of the one unit game any one of a single hit, a two-base hit, a three-base hit, a home-run hit and an easy fly when a pinball enters said special prizewinning port, the control means further lets the batter bat a ball thrown by the pitcher in accordance with the execution result, and changes the display content to a scene depicting conditions after the ball is batted and displays the result of the one unit game on said display device; and wherein said special condition generating means generates the special condition corresponding to a score when the execution result of the one unit game makes the score corresponding to the predetermined condition on the basis of a combination with the game scene that was displayed just before the one unit game started.

9. The pinball machine according to claim 8 wherein said display means increments the out count and also resets the strike 3 count and the ball count to zero respectively when the execution result of the one unit game determined by said control means is an easy fly or a third strike in a state where the one unit game is not completed, and wherein said display means resets the strike count, the ball count, the out count and the get-to-base condition when the out count is set to 3.

10. The pinball machine according to claim 8 wherein said control means displays on the display means a single-base hit rate, a two-base hit rate, a three-base hit rate, a home-run hit rate and an easy fly rate for each of up to nine batters in turn every one unit game, the execution result of the one unit game being based on the hit rates of the batter appearing on the scene at that time.

* * * * *